US012258197B2

(12) United States Patent
Sawyer

(10) Patent No.: US 12,258,197 B2
(45) Date of Patent: Mar. 25, 2025

(54) SPORT KIT BOX FOR HANGING AND DRYING

(71) Applicant: 1368576 B.C. LTD, Victoria (CA)

(72) Inventor: Kyle Sawyer, Victoria (CA)

( * ) Notice: Subject to any disclaimer, the term of this patent is extended or adjusted under 35 U.S.C. 154(b) by 0 days.

(21) Appl. No.: 18/695,272

(22) PCT Filed: Sep. 26, 2022

(86) PCT No.: PCT/CA2022/051426

§ 371 (c)(1),
(2) Date: Mar. 25, 2024

(87) PCT Pub. No.: WO2023/049995

PCT Pub. Date: Apr. 6, 2023

(65) Prior Publication Data

US 2024/0327095 A1 Oct. 3, 2024

Related U.S. Application Data

(60) Provisional application No. 63/249,759, filed on Sep. 29, 2021.

(51) Int. Cl.

| | |
|---|---|
| ***B65D 81/00*** | (2006.01) |
| ***B65D 25/02*** | (2006.01) |
| ***B65D 81/26*** | (2006.01) |
| ***B65D 85/18*** | (2006.01) |
| ***D06F 59/04*** | (2006.01) |

(52) U.S. Cl.

CPC ..... *B65D 81/263* (2013.01); *B65D 25/02* (2013.01); *B65D 85/18* (2013.01); *D06F 59/04* (2013.01)

(58) Field of Classification Search

CPC ..... B65D 81/263; B65D 25/02; B65D 85/18; D06F 59/04

USPC ..... 34/202

See application file for complete search history.

(56) References Cited

U.S. PATENT DOCUMENTS

| | | | | |
|---|---|---|---|---|
| 5,592,750 | A | 1/1997 | Eichten | |
| 6,085,436 | A * | 7/2000 | Peet | D06F 59/04 34/106 |
| 6,263,591 | B1 * | 7/2001 | La Porte | F26B 9/003 34/106 |
| 6,327,792 | B1 * | 12/2001 | Hebert | A47L 23/205 34/107 |
| 9,462,796 | B1 * | 10/2016 | Ellis | A47C 7/62 |
| 11,317,748 | B2 * | 5/2022 | Foster | A47G 29/141 |
| 11,377,290 | B2 * | 7/2022 | Morine | B65D 81/05 |

(Continued)

FOREIGN PATENT DOCUMENTS

| | | |
|---|---|---|
| CA | 2699847 | 7/2011 |

*Primary Examiner* — John P Mccormack

(74) *Attorney, Agent, or Firm* — Damien G. Loveland; Valuetech Patent Agency Inc.

(57) ABSTRACT

It is often difficult to dry sports kits in a holder. Here, a portable sport kit box has an air circulation structure that assists in drying activewear or warming it before use. A false bottom distributes airflow in the box. Ducts are present in accessory holders. The tub walls have slots for holding the lid in a vertical plane to hang clothes on for initial draining. A drain plug drains water after washing activewear. A filter is mounted on a wall through which air enters or exits the box. The filter can be connected to an external fan powered by a vehicle or internal or external battery. A solar panel, internal heater or internal fan may be included.

23 Claims, 15 Drawing Sheets

(56) References Cited

U.S. PATENT DOCUMENTS

| | | | | |
|---|---|---|---|---|
| D969,176 | S * | 11/2022 | Zhao | D15/79 |
| 2015/0113824 | A1 | 4/2015 | Goulet | |
| 2018/0015938 | A1* | 1/2018 | DeFrancia | B65D 25/04 |
| 2018/0105972 | A1* | 4/2018 | Smoots | F26B 21/008 |
| 2019/0230893 | A1* | 8/2019 | Errante | A01K 1/031 |
| 2023/0024938 | A1* | 1/2023 | Meyer | B63C 11/02 |

* cited by examiner

SPORT KIT BOX FOR HANGING AND DRYING

FIELD OF INVENTION

This invention relates to a multi-functional sport kit box for carrying and storing activewear. More specifically, this invention relates to a portable box with detachable holders organized for storing and carrying activewear and removing moisture and odor, or cleaning after use.

BACKGROUND OF INVENTION

Damp garments, sports and athletic equipment, booties and shoes are carried and dried in bags with natural air circulation. Without adequate drying, garments and sports equipment that retain water grow mold, mildew, and have unpleasant odors.

Methods for airing, drying, and removing odors from activewear after use have been developed over many years, and there are now various techniques available for drying activewear. Existing drying bags or containers vary by incorporating different ways of admitting, recirculating and expelling air. Dried and heated air is forced with a fan to enter and circulate between stored wet contents. The resulting damp air, with a high level of water vapor, leaves the bag by passing through filters made of materials such as carbon or activated charcoal.

The bags or containers for this purpose are usually made with porous walls, for example fabrics such as nylon or polyester, which allow heated air to circulate and decrease the moisture of the contents. An increased flux of dried and heated air is required because of the short air path within the interior of the bag. More specifically, the porous walls may cause some dried air to be discharged into the environment prior to being recirculated within the bag, which may reduce the effectiveness of drying the contents.

In addition, the lid of the container or bag is typically made from porous materials and can be opened and closed using a zipper or releasable fasteners. This may also allow the dry air to leave the bag prematurely. As a result, the fan and/or dryer need more time and energy to circulate new air to effectively air and dry the contents of the bag and then expel the air through the activated charcoal or carbon filters to remove odors and humidity. The drying process would also be slower in a situation where contents that are sodden or dripping with excess water are stored without first wringing out the clothes or draining the water.

Furthermore, different types of activewear require specific pockets for carrying and drying parts of the equipment. In existing bags there are usually non-detachable pockets for securing and organizing contents, to make them more exposed to the drying air.

In general, bags are foldable, meaning wet clothes may be in contact with shoes when storing, which would then require additional refreshing or washing of the clothes using further accessories.

This background information is provided to reveal information believed by the applicant to be of possible relevance to the present invention. No admission is necessarily intended, nor should be construed, that any of the preceding information constitutes prior art against the present invention.

SUMMARY OF INVENTION

The inventor has realized that there is a need for a multi-purpose portable, durable, and recyclable plastic box with a lid and detachable pockets, holders or compartments that can be rearranged and used for a variety of sports or activities. This box not only dries and refreshes the specific activewear, but also provides an option to wash it when needed. Additionally, the box provides an option for hanging wet clothes. Once the excess water has dripped off, the process for drying and refreshing the clothes is shorter and more efficient.

The present invention is directed to a portable sport kit box with a specific structure, which provides air circulation that is effective for drying used activewear or warming it prior to use. The box includes a tub having opposed side walls, opposed end walls, a floor, an opening opposed to the floor, and a lid for closing the tub. The lid may be mounted on the tub opening for securely carrying, storing, and drying the activewear. The tub has receptacles or slots positioned on the interior side of at least one wall for inserting the lid in a vertical orientation relative to the floor of the tub for hanging wet clothes, to begin the drying process or to dry clothes to be ready for use for different activities. The vertical orientation of the lid is used for the initial drying of substantially wet clothes and the removal of excess water with natural airflow prior to the drying process with heated air within the box. Additionally, the box includes a filter mounted on one or more walls of the tub via which airflow enters the box, or via which air is exhausted. The filter may be combined with a detachable fan with a car plug-in option, for example, when at a sports location away from home or away from a mains power outlet. The floor of the box is equipped with a false bottom, which is perforated to discharge the airflow into the inner environment of the box. Additionally, the tub and tub floor may be configured for washing dirty activewear. The floor or a bottom of a wall has at least one pluggable opening for water drainage.

In some embodiments, the lid can be used as a platform to stand on while changing clothes, for example when the user must go from one event to another, such as from one football game to another, or to change prior to, between, or after games or activities. In some embodiments, the lid has a non-slip surface for standing on, and which is also useful for using the lid as a tray to carry clothes, shoes, or other accessories on.

In some embodiments, the lid includes a retractable drying rack that is slidable in and out of an interior space between the top and the bottom surfaces of the lid. The movement of this retractable rack can be regulated with a locking mechanism according to the user's needs or preferences.

In some embodiments, holders or holding compartments are perforated, replaceable, and interchangeable, with attachment means for fitting into at least one slot on the inner surface of the walls of the tub.

Disclosed is a sport kit box comprising a tub, a lid that closes the tub, and a slot on each of two opposing sides of the tub, each slot shaped to engage with an edge of the lid so that the slots support the lid in a vertical plane when the tub is resting on a horizontal surface.

This summary does not necessarily describe all the features of the invention.

BRIEF DESCRIPTION OF DRAWINGS

The following drawings illustrate embodiments of the invention, which should not be construed as restricting the scope of the invention in any way.

DETAILED DESCRIPTION

A. Exemplary Embodiment

Figure 1:
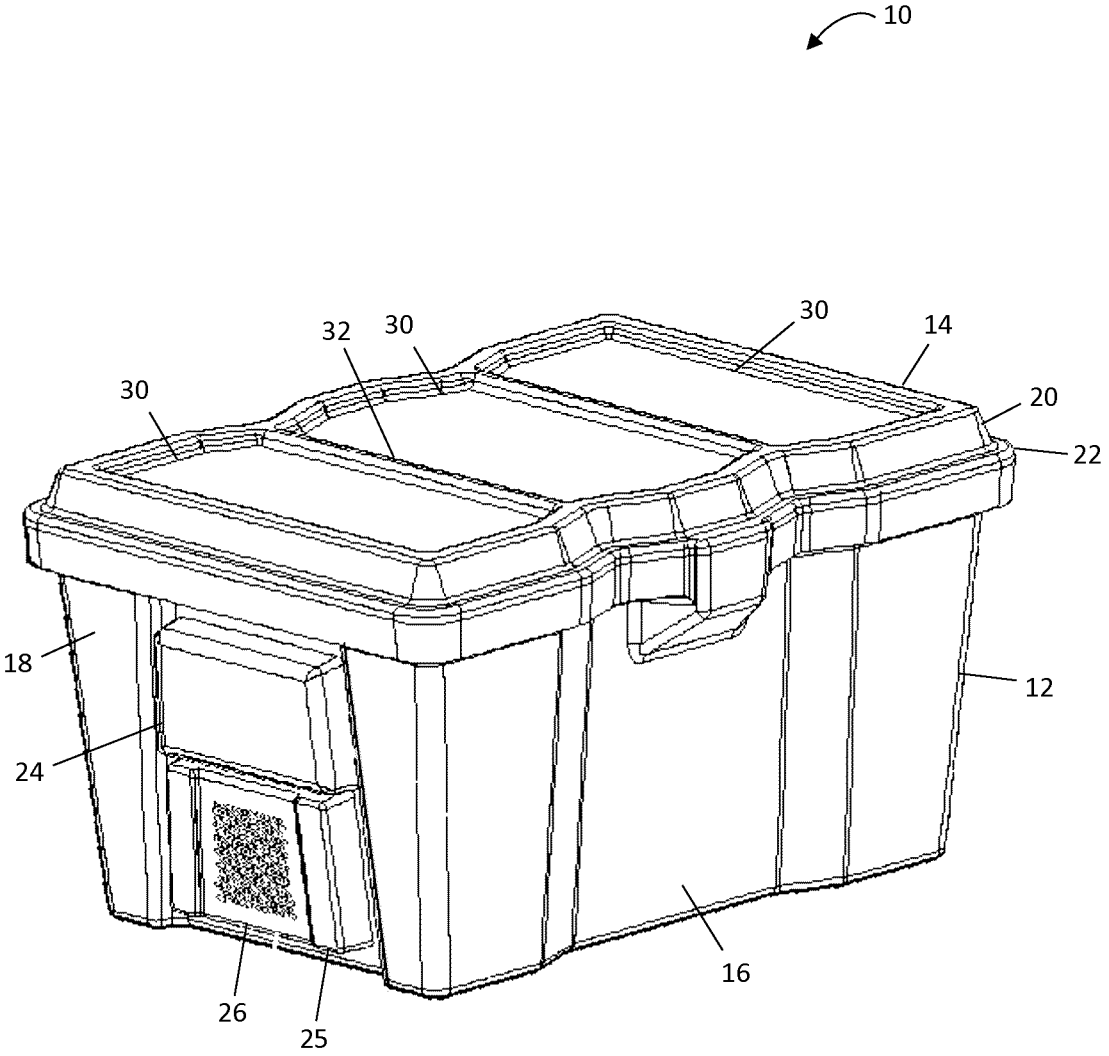
FIG. 1 is a view of an example sport kit box according to an embodiment of the present invention.

Referring to FIG. 1, this shows an exemplary reusable and portable sport kit box 10 with a tub 12 or tote and a lid 14, in a closed position, made of recyclable, sturdy and rigid yet lightweight plastic. The tub 12 has two opposing side walls 16 approximately perpendicular to two opposed end walls 18, a floor, and an opening opposed to the floor, defining an approximately cuboid interior with an open box structure and sides slightly sloped off-vertical. The opening can be closed with a detachable lid 14, which has a wall 20 extending around the lid and a rim 22 that extends outwards from the wall 20 at the bottom of the wall 20. The rim 22 is configured to be mounted on the opening of the tub 12. The lid 14 fits to the tub 12 with a tight or snap-fit connection to securely store and carry clean activewear and to dry it after use. In other embodiments, the lid is a deliberately loose fit to allow air that is pumped in through the fan to escape, or for air to be drawn into the tub when the fan draws it out of the tub.

The exterior of the tub 12 is dimensioned to have extensions or receptacles for holding detachable compartments, configured to be mounted on or positioned outside at least one of the walls 16, 18 of the tub 12. For example, a removable, lockable box 24, for holding tools and small accessories for sports or outdoor activities, such as goggles, ropes, whistles, flashlights, etc. may be included. Other exterior components may be a speaker.

On the exterior surface of the walls 16, 18, another set of extensions or receptacles 25 may be positioned for holding a detachable filter 26. The filter 26 has numerous small openings with a mesh-like structure to allow airflow to enter or exit the tub 12. The tub has at least one perforated section or hole inside and adjacent to the filter openings when the filter is mounted on the tub. An internal or external fan may be combined with the filter 26 to force heated dry air into the interior of the box 10, or to extract damp air from the box. The fan may have a car plug-in option to warm activewear before use or dry it after use. The filter 26 may remove dust and/or odors from the air that passes through it.

The outer surface of the lid 14 may be partitioned into sections 30 with slight ridges or protrusions 32 to prevent sliding of clothes or accessories that are placed on top of the lid, particularly when carrying them from one place to another. The lid 14 may be used as a standing platform for users to change clothes between events, for example, between one football game and another. The lid may be made from a strong yet somewhat elastic (i.e. non-brittle) material that is highly impermeable to both moisture and air, resistant to abrasion and heating, and smooth to avoid tearing activewear, for example, plastic. In some embodiments, the lid is strong enough to support the weight of user without breaking. Different strengths of the box lid may be made depending on the weight of the user, for example, whether the user is a child or an adult.

Figure 2:
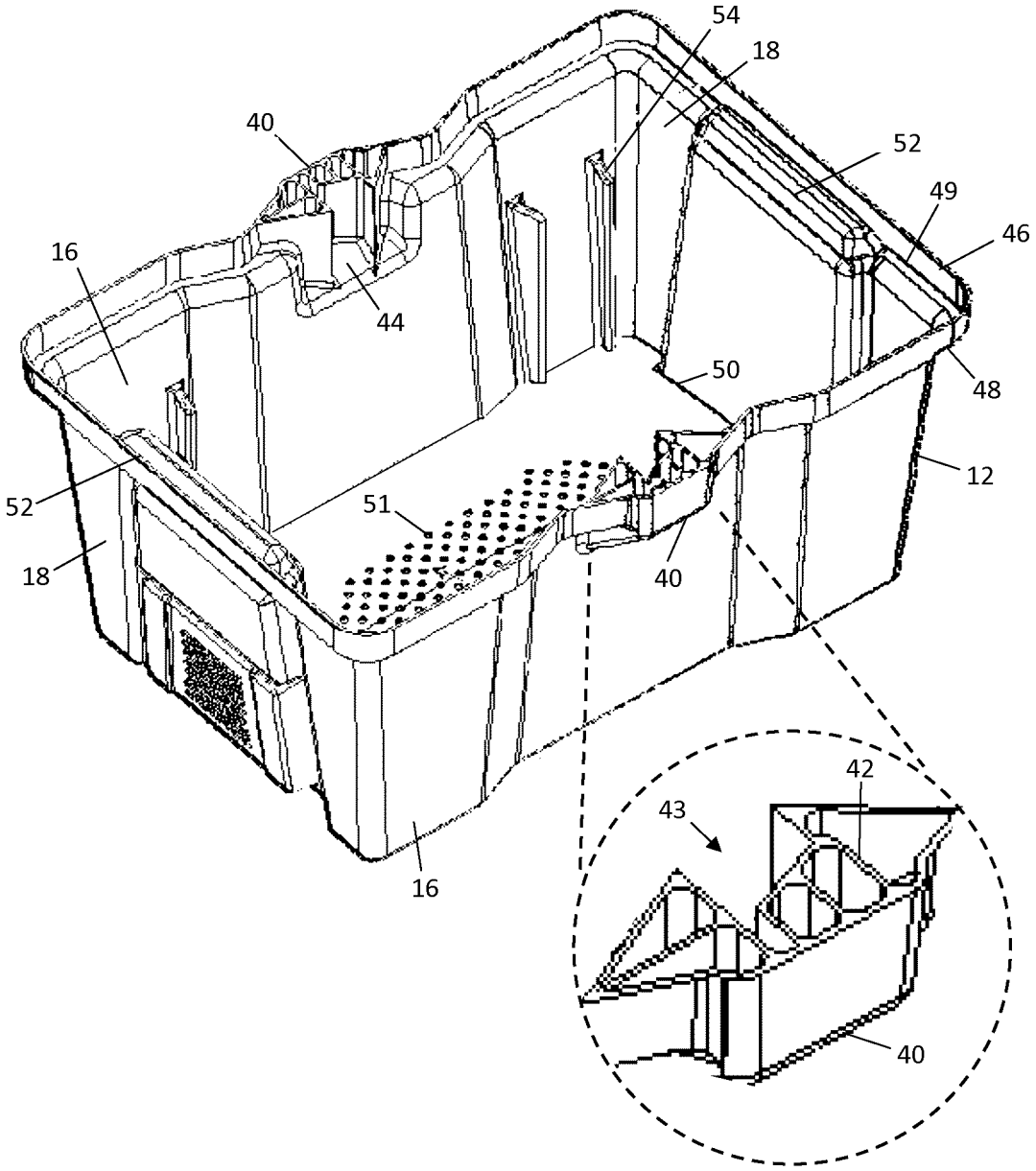
FIG. 2 is a view of the inside of the sport kit box of FIG. 1.

Referring to FIG. 2, the tub 12 may have two protrusions 40 for accommodating reinforced features or ribbing 42 that defines a slot 43 or receptacle to hold the lid 14 in a vertical orientation, i.e. in an approximately vertical plane when the box is on a level surface. The lid, when vertical, is used for holding sports equipment or for an initial drying and removal of excess water with natural airflow from wet, sodden or dripping clothes prior to the drying process with, for example, heated air. Each slot 43 inside the protrusions 40 forms an oblique surface 44 at its base, that may correspond to a similarly aligned surface of the wall 20 on the side of the lid 14. The protrusions 40 may be positioned on opposite side walls or opposite end walls to accommodate slots 43 for holding the lid. The outer walls of the slots 43 are bordered with multiple elongated and vertically extending ribs 42 between which are openings or recesses for structural rigidity and lightness of weight. The geometry of the slots 43 is chosen for holding the detachable lid 14 in a vertical plane relative to the floor of the tub. The tub 12 has indents 52 at the top of its side or end walls, used as handles for carrying or moving the box 10 or only the tub 12.

The tub 12 has a continuous rim 46 around an outwardly extended upper wall 48, which stands out from the main portions of the side walls 16 and end walls 18. The rim 22 of the lid has an engagement surface, adjusted to engage with the rim 46 of the tub 12. The rim 22 of the lid 14 may engage over, on or inside the rim 46 of the tub 12, depending on the embodiment. The geometry of the lid rim 22 generally corresponds to the geometry of the tub rim 46. A ledge 49 is present inside the tub 12 and near the opening of the tub for structural rigidity, and in some embodiments for supporting the lid when the box is closed.

The tub's floor has a false bottom 50 with a perforated surface for airflow to exit into the main environment in the box from the filter, or vice versa. The perforations 51 in the false bottom 50 may also help for draining water when washing dirty and used activewear placed in tub 12. The floor of the tub also includes a drain hole and plug for draining water when washing dirty contents, or for emptying water that has dripped from the contents.

One or more pairs of walls 54 forming accessory support mounts project from the interior surface of the side wall 16 and/or end wall 18 to form slots for securing accessory supports. The accessory supports are detachable, interchangeable and may be perforated compartments or holders, depending on the type of accessories specific to various sports or activities. For example, up to four or more slots may be present. The perforated compartments or holders are dimensioned for circulation of dry and heated air for warming up contents before use or drying them after use. This makes the box useful for storing, carrying, and drying any type of activewear according to the user's individual needs and preferences. For example, the detachable compartments and holders may be glove inserts, boot inserts, a goggle holder, helmet mount, wet suit mount, video or camera case, boxing glove mount or jujitsu gear mount. In some embodiments, beer or cup holders, etc. may be mounted between the pairs of walls 54 or in or on other accessory support mounts. The accessory supports may be selected from a range of interchangeable off-the shelf compartments and holders that are made to fit the box. In some embodiments, the lid locks the holders and/or accessory supports in place when closed, by preventing movement of the accessory supports in a vertical direction. The accessory support mounts prevent movement of the accessory supports in a horizontal plane. The accessory support mounts on the inner walls of the tub 12 may also have a different configuration, e.g. incorporating recesses, slots, catches, hooks and projections, arranged for securing the accessory mounts.

As can be seen from FIGS. 1 and 2, at least one end of the lid has a smaller dimension than a span across the tub, so that the lid can fit in the slots at either side of that span.

Figure 3:
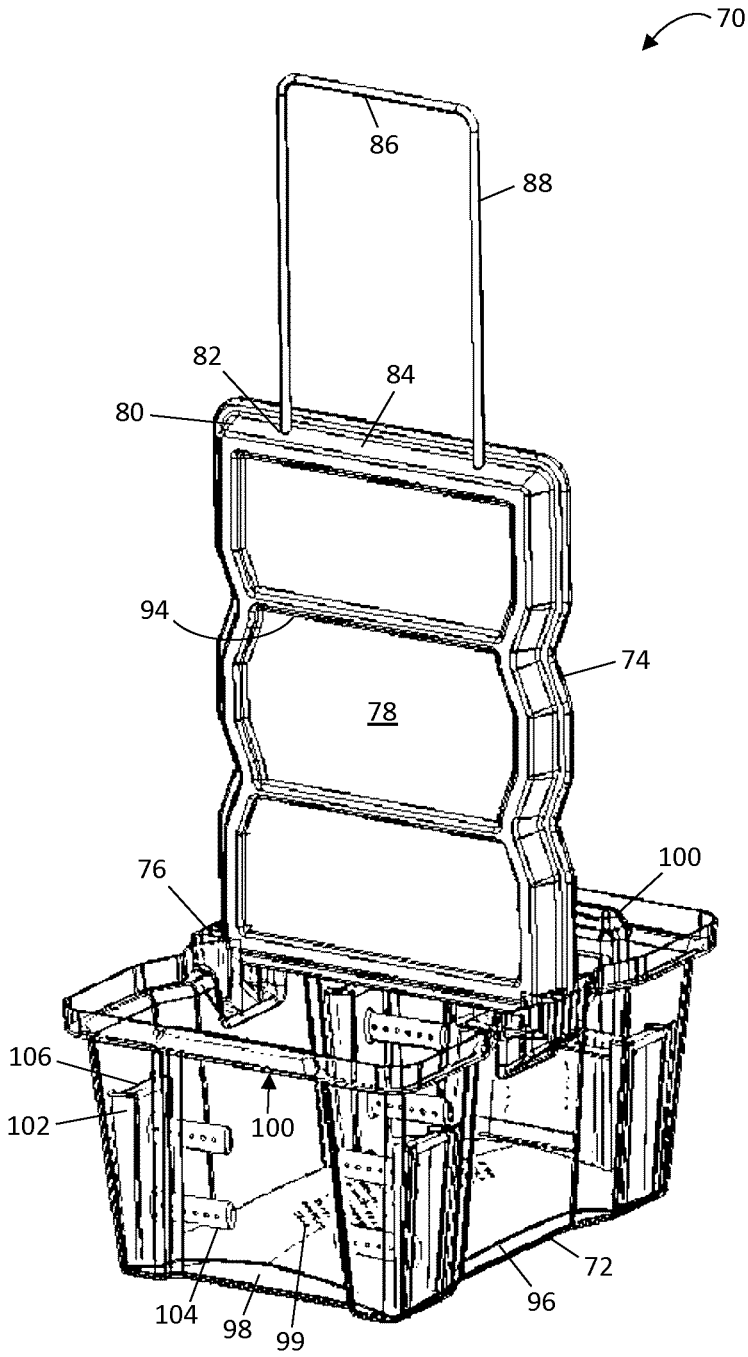
FIG. 3 is a view of an example sport kit box according to another embodiment of the present invention.

Referring to FIG. 3, this shows another embodiment of a sport kit box. Box 70 has a tub 72 and lid 74 mounted or inserted in reinforced receptacles 76 at the top of two of the side walls. The reinforced receptacles 76 are positioned to hold lid 74 in a vertical orientation. Lid 74 has one or more top surfaces 78 and an opposing bottom surface connected with a wall 80 therebetween, creating a hollow body with a generally planar, rectangular shape corresponding to the shape of the tub 72. The geometry of the receptacles 76 generally corresponds to the geometry of the cross-section of the lid 74 at its edges on the shorter sides of it, near the corners.

Additionally, lid 74 may have one or more openings 82 on its end wall 84, providing access to a cavity to accommodate a retractable drying rack 86 for hanging sports equipment. The retractable drying rack 86 is slidable into an interior space between the top surface 78 and the bottom surface of the lid 74 through the openings 82. The rack 86 may slide into the lid from a fully extended, or open position, to a fully retracted, or closed position. The rack 86 may be kept in an extended or closed position with a locking mechanism according to the user's needs or preferences. The locking mechanism may be a series of indents that accommodate a sprung projection, or a slidable collar that may be tightened by a screw to a strut 88 of the rack, or any other suitable mechanism. The rack 86 may have different shapes and forms, for example with the struts made of bar or tube, provided that it can slide into the lid. The rack 86 is for an initial drying of wet, sodden or dripping clothes and the removal of excess water with gravity and natural airflow prior to a drying process with heated air, or simply for hanging clothes or other sports accessories. The rack has at least one strut that is slidable in and out of one end of the lid, the rack being adjustable between a retracted position in which the strut is mostly inside the lid and an extended position in which the strut is mostly outside the lid.

A filter is detachable from an end wall of the tub with a configuration so that it is easily mounted or positioned on at least one outwardly extended fitting protruding from the outer surface of the tub's end wall. The tub 72 has at least one hole or perforated section inside and adjacent to the filter openings when the filter is mounted on the tub. On the exterior of filter, a fan may be positioned or mounted to force heated, dry air into the interior of the tub 72. The fan may have a car plug-in option for warming activewear before use or drying it after use. A removable and lockable box is positioned on at least one of the outside wall surfaces for holding tools and small accessories for sports or outdoor activities, such as goggles, ropes, whistles, flashlights, etc.

The top surface(s) 78 and optionally the bottom surface of the lid 74 may be partitioned into sections with slight protrusions or ridges 94 on the surfaces of one or both sides of the lid to prevent sliding of clothes or other sports accessories when placed on them. Additionally, users may use the lid as a standing platform for changing clothes between events, for example, between one football game and another.

A slightly curved base forming a false bottom 96 with a perforated surface may be placed on floor 98 of tub 72. The false bottom 96 may be used for distributing dried and heated airflow, allowing it to evenly pass through the space created between it and the floor 98, and throughout the wet contents placed in the box 70. The perforations 99 in the false bottom may also allow water to drain to the bottom of the tub, and drained out via a pluggable outlet.

One or more slots 100 with inverse U-shaped cross-sections are formed in two places in the outside of the upper rim of the tub, to be used as handles for carrying or moving the box 70.

Multiple walls 102, pairs of which form slots, project from the interior surface of at least one side of the tub, for securing accessory supports. The accessory supports may be detachable, interchangeable, and perforated compartments or holders depending on the type of accessories specific for various sports or activities. The perforated compartments or holders are dimensioned for dry and heated air circulation for warming up contents before use or drying them after use. For example, one type of accessory support includes at least one hollow perforated arm 104, extending from a ducted base 106 that slides between two walls 102. This allows heated and dry air to flow through the accessory support when holding accessories such as gloves, booties, etc. Another type of accessory support is a drying platform or a goggle holder.

Figure 4:
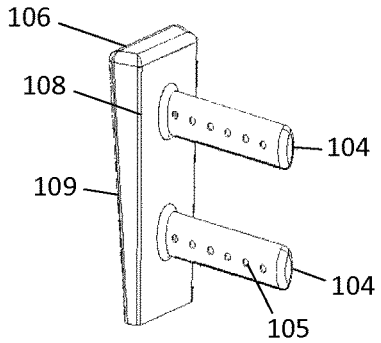
FIG. 4 is an isometric view of an accessory support present in the box of FIG. 3.

Referring to FIG. 4, this shows an example of a sport kit box's accessory support. The accessory support, as previously described, includes at least one outwardly extended perforated arm 104 with a generally horizontal axis, relative to the approximately vertical axis of ducted base 106. The ducted base is dimensioned to fit into slots formed on the interior surface of the walls of the tub 72. The ducted base 106 has a substantially planar shape with a vertical wall 108 adjacent and perpendicular to the arms 104 and a slightly inclined back wall 109 that matches the angle of the side wall or end wall of the tub. The ducted base 106 is dimensioned to slide and easily mount into slots formed by walls 102 on the interior surface of the outer tub walls. Airflow through the accessory support is through an aperture at the bottom or back of the ducted base 106, and through the perforations 105.

Figure 5:
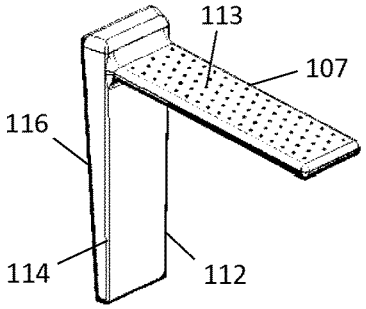
FIG. 5 is an isometric view of a drying platform present in the box of FIG. 3.

Referring to FIG. 5, this shows an example of a sport kit box's accessory support in the form of a drying platform 107. The drying platform 107 has a substantially rectangular or square shape in a horizontal orientation relative to the approximately vertical, ducted base 112, perforated with holes 113. The base is dimensioned to fit into a slot formed by two walls 102 on the interior surface of the walls of the tub 72 and to fit into other similar slots on the interior surface of the walls of tub 12, interchangeably. The base of the accessory support has a substantially planar shape with vertical wall 114 and an opposed, slightly inclined wall 116, for sliding and easily mounting into slots positioned on the interior surface of the walls of the sport kit box. Airflow through the accessory support is through an aperture at the bottom or back of the ducted base 112, and through the perforations.

Figure 6:
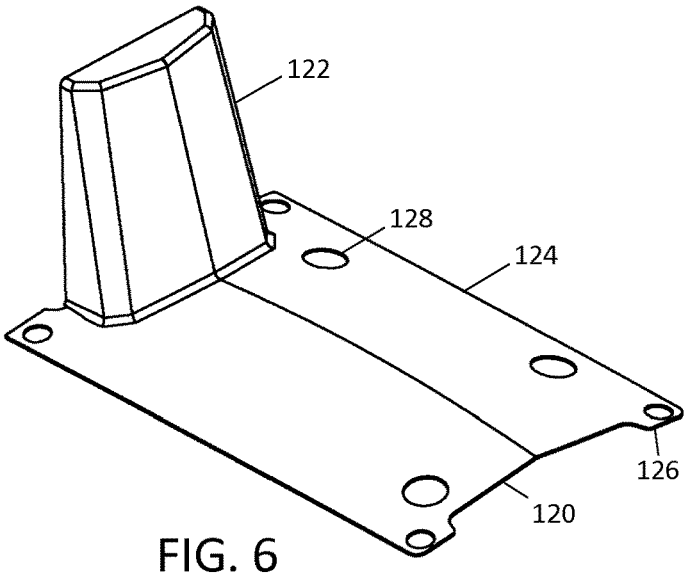
FIG. 6 is an isometric view of a false bottom used as a fan duct and a drip deflector, according to an embodiment of the present invention.

Referring to FIG. 6, this shows an example of a sport kit box's false bottom 120 with a fan ducting 122 and drip deflector 124, made in one piece. Drip deflector 124 has two slightly sloping halves and at least one tab 126 adapted to be positioned to fit into a corresponding locating feature on the inner surface of the tub floor or tub wall of a sport kit box. Sand that may be on clothing can fall off and be directed to the sides of the tub by the drip deflector, or can fall through holes in the drip deflector. The ducting 122 deflects dry and heated air entering through the filter down and the out from the sides of the false bottom 120. The false bottom 120 may also be perforated with holes 128. Channels may be incorporated in the false bottom to guide the flowing air into the accessory supports, or channels may be formed on the floor of the tub.

Figure 8:
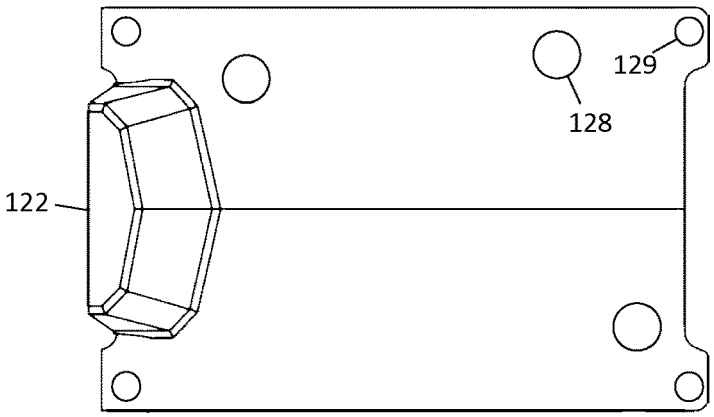
FIG. 8 is a plan view of the false bottom of FIG. 6.
Figure 7:
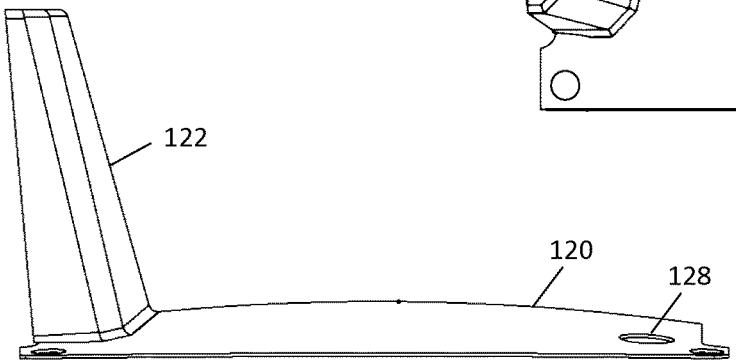
FIG. 7 is a side elevation of the false bottom of FIG. 6.

FIG. 7 shows a side view of the false bottom 120 with ducting 122, and FIG. 8 shows a plan view of it. Some of the holes 128 may be for airflow through one type of accessory support, while others of the holes 129 may be for airflow through another type of accessory support or clothing support. The shape, position, number and size of the venting holes 128, 129 may be different in other embodiments.

Figure 9:
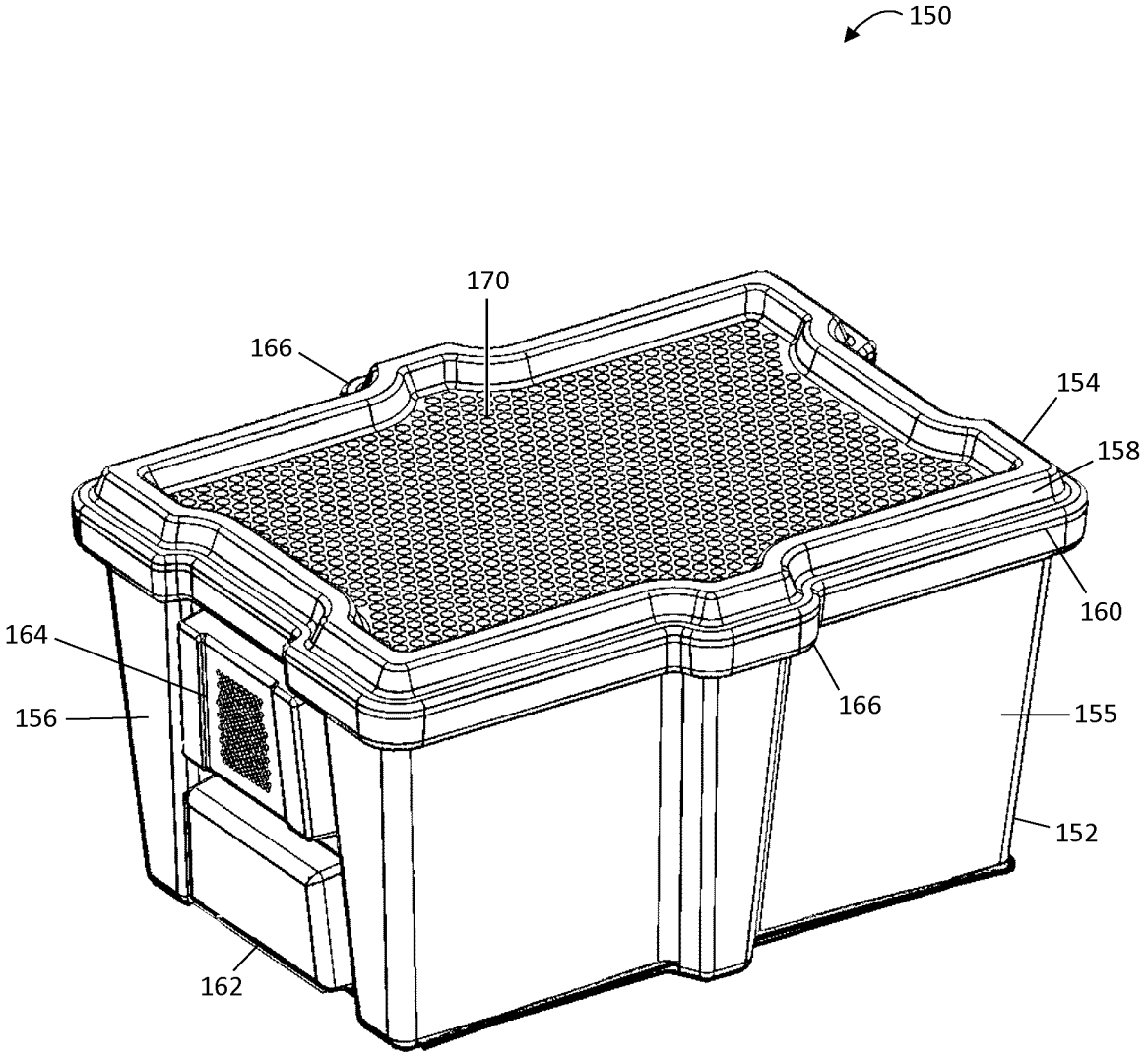
FIG. 9 is a view of a sport kit box according to another embodiment of the present invention.

Referring to FIG. 9, this shows a further embodiment of a sport kit box 150 with a tub 152 and a lid 154 in a closed position, made of recyclable plastic, for example. The tub 152 has opposed side walls 155, generally perpendicular to opposed end walls 156, a floor, and an opening opposed to the floor defining a generally cuboid interior with sloping sides. The detachable lid 154 has a wall 158 and a rim 160 that extends outward from the wall 158 and is configured to engage with the opening of the tub 152. The opening of the tub 152 has elevated edges located outwards from the main walls 155, 156 of the tub, and the rim 160 and wall 158 of the lid 154 are, in some embodiments, joined in a tight or snap-fit reversible connection to the tub 152.

A lockable box 162 is positioned on at least one of the outside wall surfaces 155, 156 for holding tools and small accessories for sports or outdoor activities, such as goggles, ropes, whistles, flashlights, etc. A filter 164 is detachable with a configuration that allows it to be easily mounted or positioned on at least one outwardly extended fitting on the outer surface of one of the tub's walls 155, 156.

Tub 152 may have one or more protrusions 166 for accommodating reinforced or ribbed slots or receptacles to hold the lid 154 in a vertical direction.

The outer surface of the lid 154 may have a non-slip covering or finish 170 to prevent sliding of clothes or accessories when placed on top of the lid when carrying them from one place to another. Additionally, users may use it as a non-slip standing platform for changing clothes.

Figure 10:
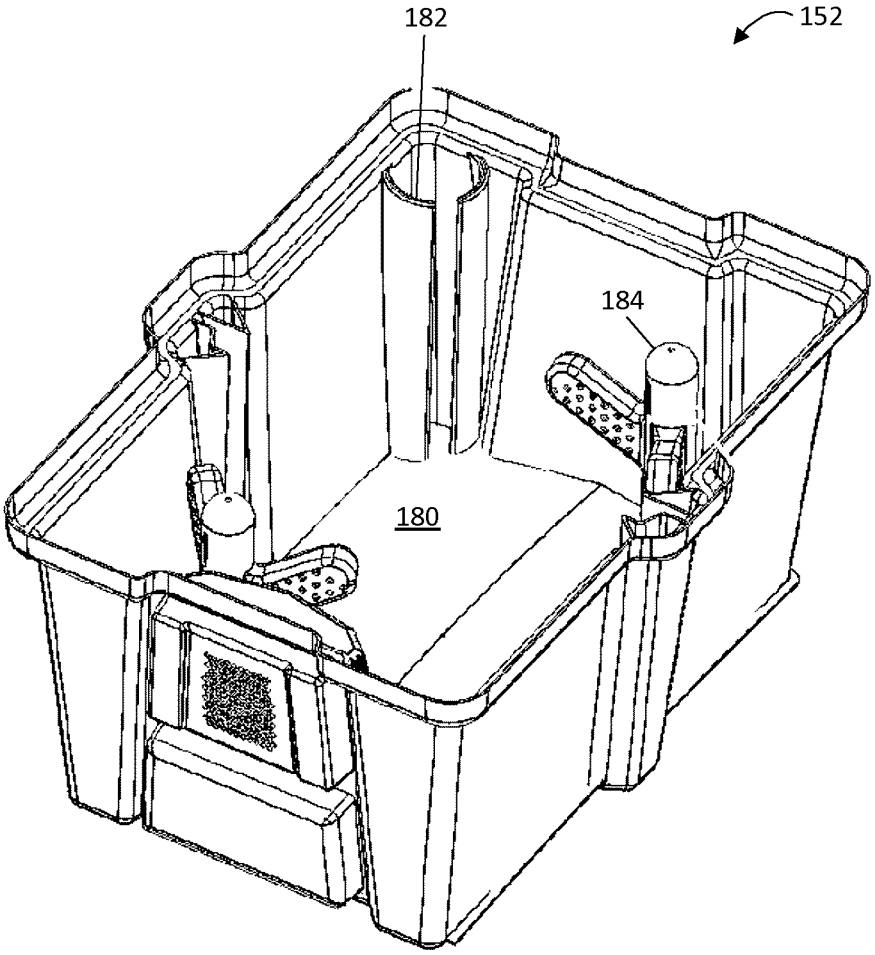
FIG. 10 is a view of the inside of the sport kit box of FIG. 9.

Referring to FIG. 10, this shows the inside of tub 152. The tub floor has false bottom 180 positioned over it, with slight declines from the central axis for deflecting drips. The false bottom 180 helps in recirculating dry and heated air within the interior of the box and through stored activewear, as it may be perforated and/or have gaps at its edges to let the air through. The air that is let through the holes or gaps may be directed into ducts that lead to accessory supports. In at least one interior corner of the tub, at least one vertical holder 182 is dimensioned to hold cans, bottles, cups, etc. One or more accessory supports 184 for drying accessories are removably attached to sockets that are molded into the floor of the tub 152. A duct inside the socket may facilitate airflow into the corresponding accessory support.

Figure 11:
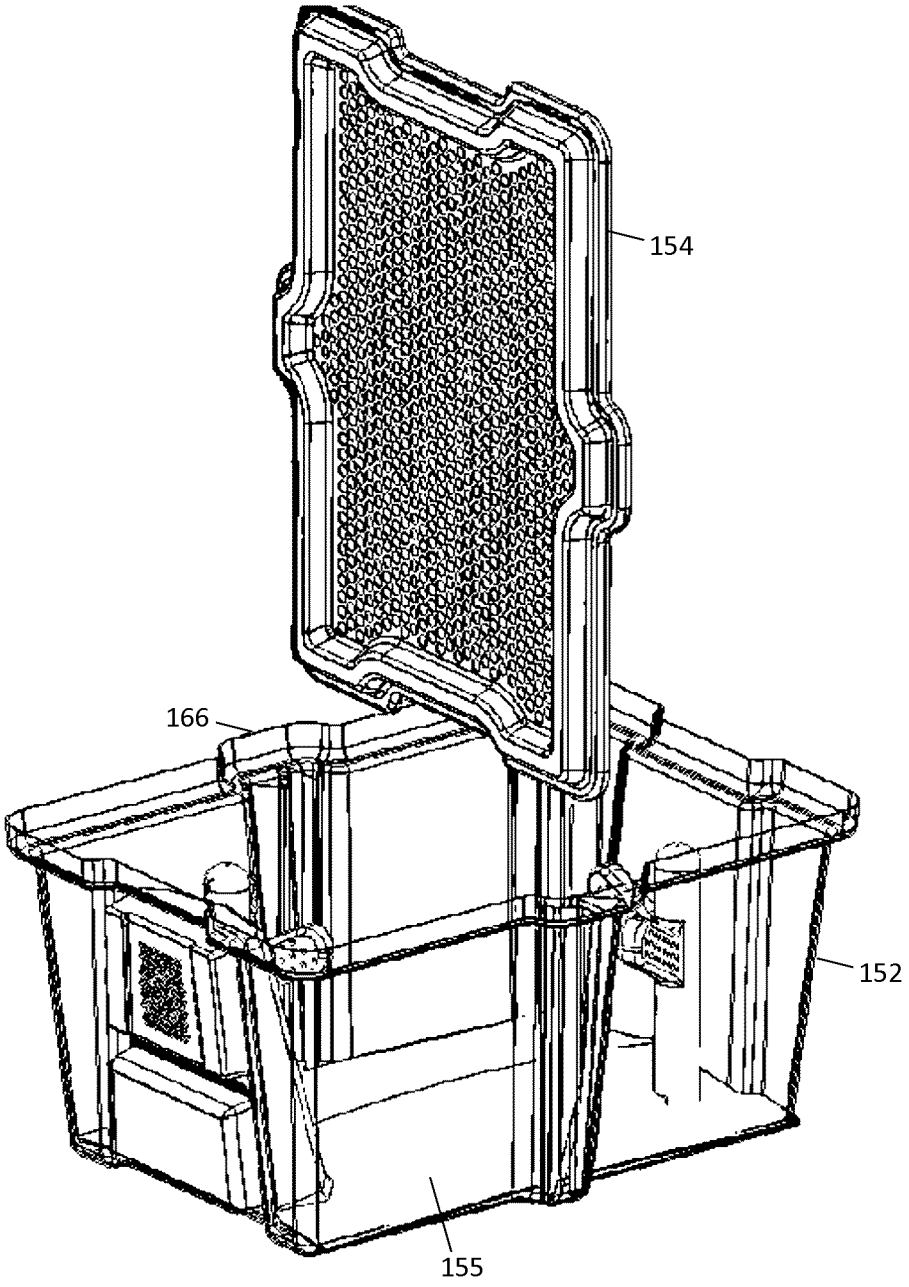
FIG. 11 is an exploded view of the tub and lid of the sport kit box of FIG. 9, with the lid oriented vertically.

Referring to FIG. 11, this shows the tub 152 with its lid 154. Here, the lid 154 is shown in a vertical orientation, aligned with the slots in the projections 166 on the side walls 155 of the tub.

Figure 12:
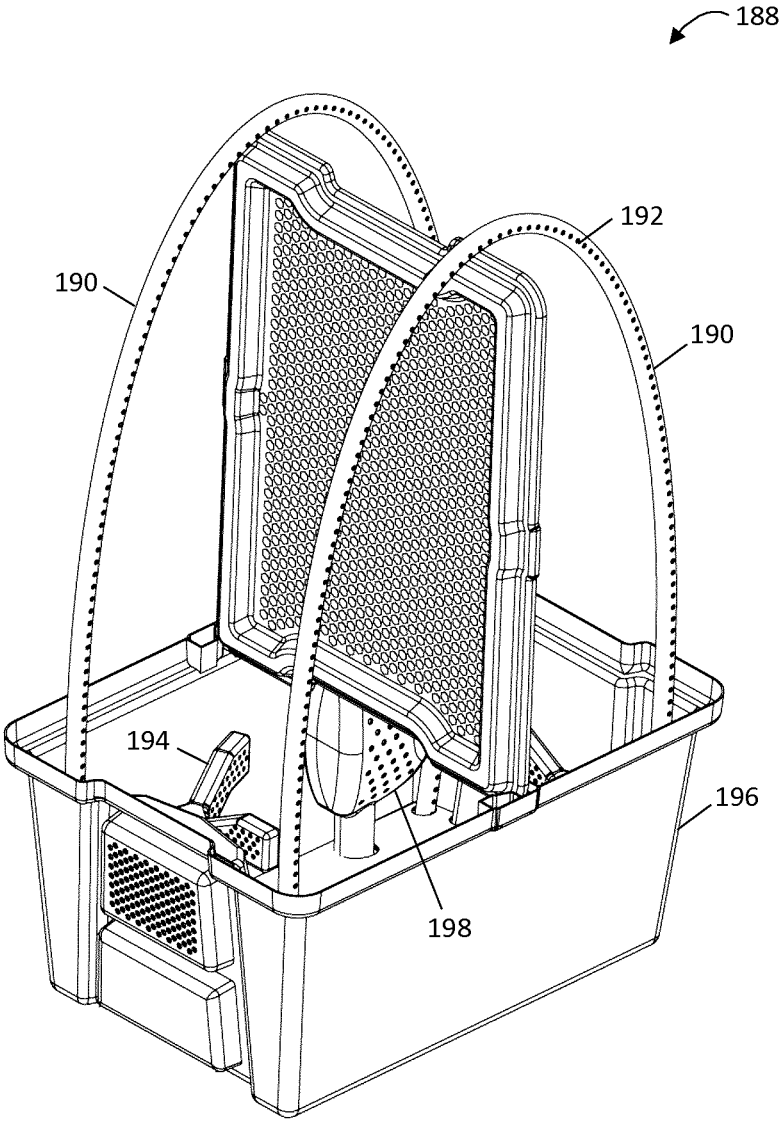
FIG. 12 is an isometric view of a sport kit box in an expanded configuration, according to an embodiment of the present invention.

FIG. 12 shows the expanded or extended configuration of an embodiment of a sport kit box 188, with detachable wetsuit drying tubes 190. The flexible drying tubes 190 may be mounted as vertical arches when the box is opened, and they may be removed and stored in the box when the box is closed. The wetsuit drying tubes 190 have holes 192 along their lengths to promote airflow for drying the wetsuit or other activewear hanging over them. Airflow may be directed into the tubes from the base of the tub, for example via the holes 129 in the false bottom 120. Accessory support 194 is visible in the tub 196, as is goggle box 198. When the sport kit box 188 is in its open and extended configuration as shown here, air may be pumped into the tub via the filter, using an attachment that fits around the filter so that a fan can pump air through the filter, down through the fan duct and through the accessory supports 194 and drying tubes 190.

Figure 13:
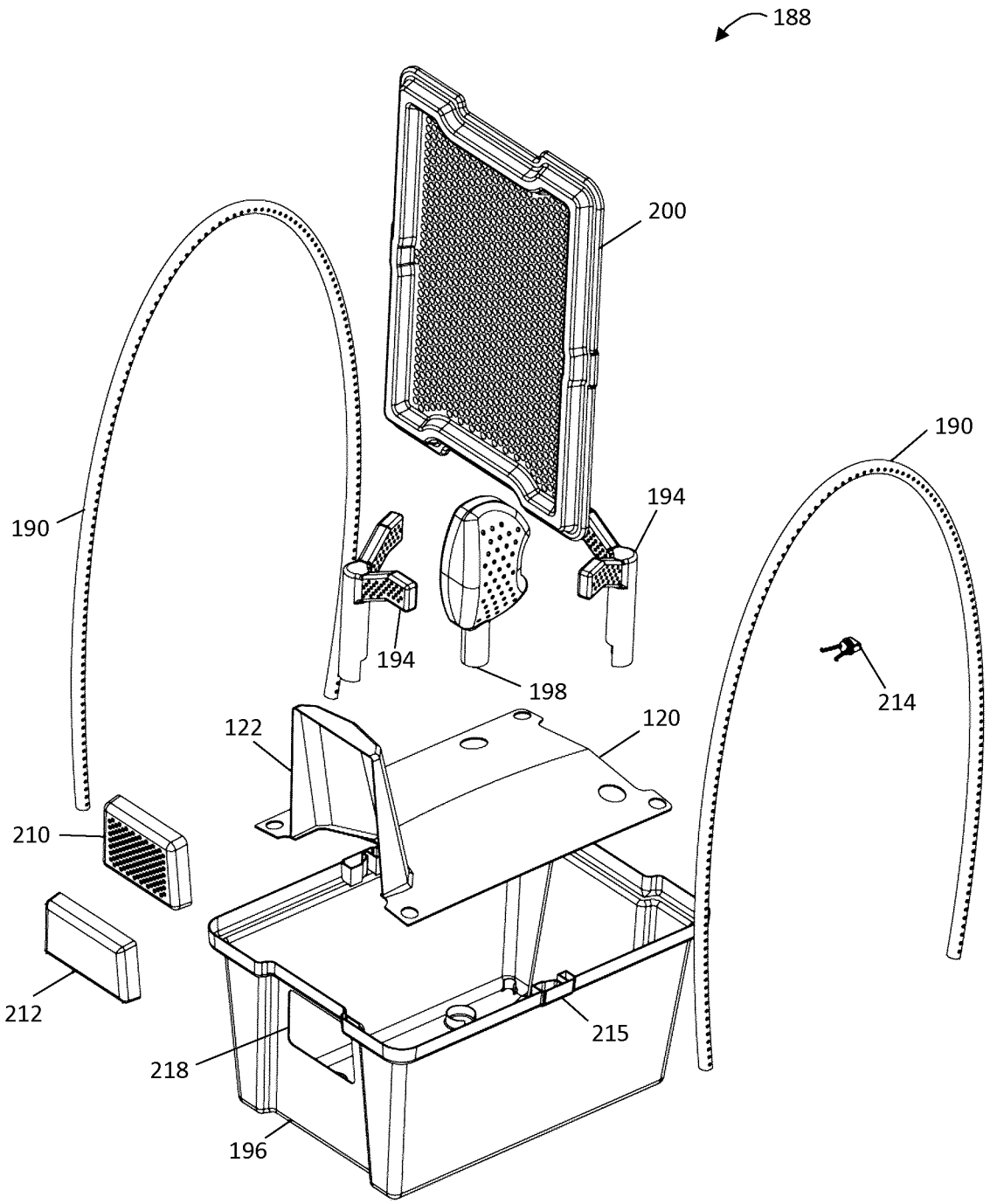
FIG. 13 is an exploded view of the sport kit box of FIG. 12.

FIG. 13 shows the components of the sport kit box 188 in an exploded view, with the lid 200 in a vertical orientation. Shown are the combined false bottom 120 and fan ducting 122, two accessory supports 194, a goggle holder 198, drying tubes 190, filter 210 and lockbox 212. Also shown is a drain plug 214 for a drain hole in the bottom of the tub 196. The fan inlet hole 218 in the tub 196 is adjacent to the filter 210 when it is in position on the tub. The tub has receptacles or slots 215 for holding the lid 200 in a vertical orientation.

Figure 14:
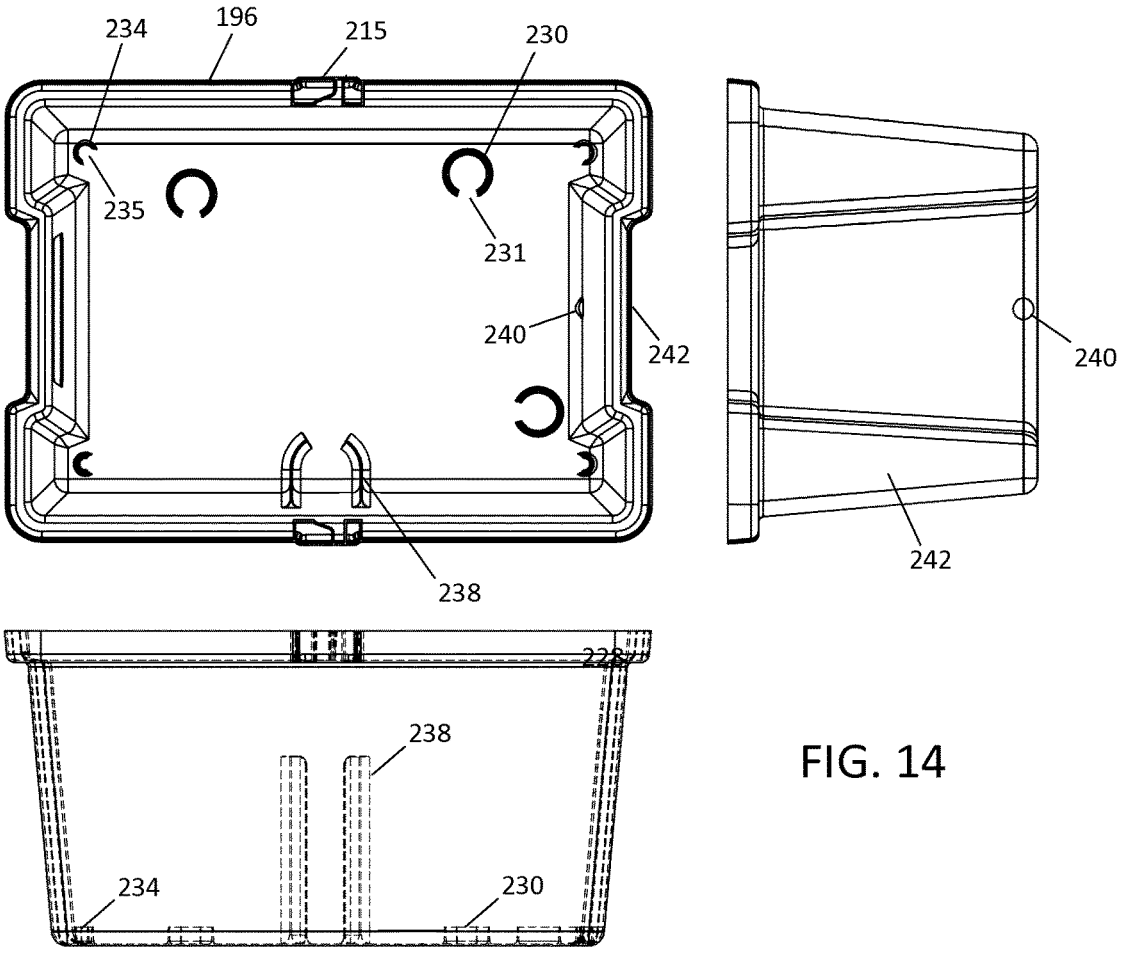
FIG. 14 is three-view technical drawing of a tub, according to an embodiment of the present invention.
Figure 15:
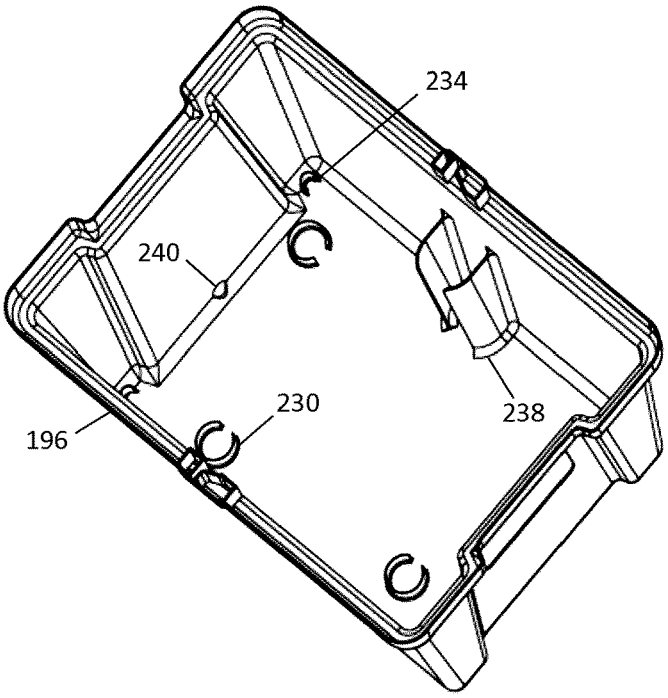
FIG. 15 is a perspective view of the tub of FIG. 14.

FIG. 14 shows the tub 196 in plan view (top, left), front elevation (bottom) and end elevation (left). Slots 215 are shown for supporting the lid vertically. Sockets 230 are shown for the accessory supports, such as accessory support 194 and goggle holder 198. The socket 230 is an incomplete or partial circular wall, with a gap 231 through which airflow may be directed from under the false bottom. The duct of the accessory support has a corresponding gap that aligns with the gap 231 in the socket wall. Smaller sockets 234 are shown for other accessory supports or the drying tubes 190. The socket 234 is an incomplete or partial circular wall, with a gap 235 through which airflow may be directed from under the false bottom. The ends of the drying tubes 190 have a corresponding gap that aligns with the gap 235 in the socket wall. Walls 238 projecting inwards from the inner surface of a main wall of the tub 196 form a beverage can or bottle holder. Drain hole 240 is shown at the bottom of the tub 196, halfway along the end 242 of the tub. FIG. 15 also shows the tub 196, with the accessory support sockets 230, the drying tube support sockets 234, the beverage holder walls 238 and the drain hole 240.

Figure 16:
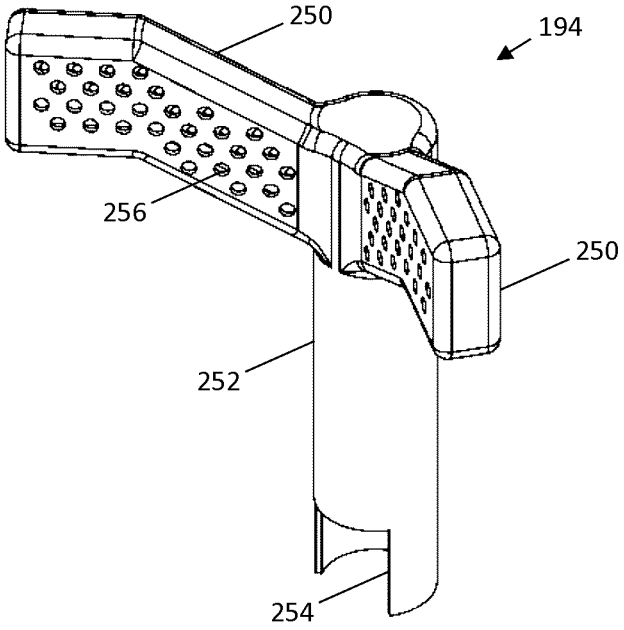
FIG. 16 is perspective view of a bootie and glove dryer, according to an embodiment of the present invention.

FIG. 16 is an accessory support 194, configured as a bootie and glove dryer, according to an embodiment of the present invention. The accessory support 194 has two drying arms 250 and a ducted support post 252. At the bottom of the post 252 is a cut-out 254 or gap that aligns with the gap 231 in a socket 230. Air can flow from under the false bottom, through the gap 254 into the post 252 and then out of the accessory holder 194 through the perforations 256 in the arms 250. Each glove of a pair of gloves may be hung over an arm 250, for example. The same applies to booties. Internal surfaces inside the accessory support 194 are smooth and corners are radiused in order to promote better airflow through it.

Figure 17:
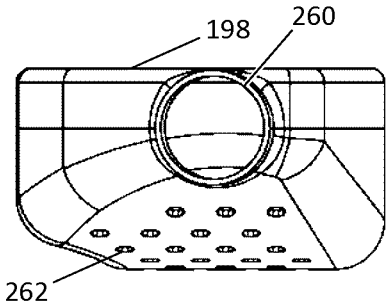
FIG. 17 is a bottom view of a goggle drying case, according to an embodiment of the present invention.

FIG. 17 is a bottom view of a goggle drying case 198. The goggle case may, for example, be made in two halves that are hinged together. The duct 260 is shown, through which air enters the goggle case, and then exits through perforations 262.

Figure 18:
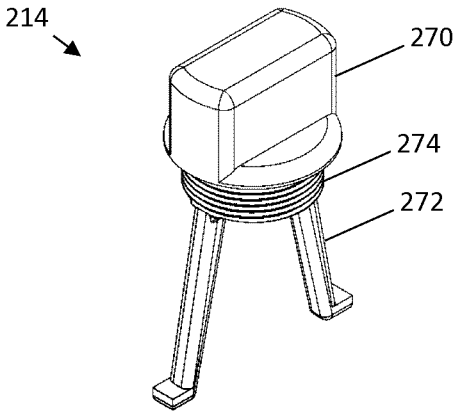
FIG. 18 is a drain plug for the tub, according to an embodiment of the present invention.

FIG. 18 is a drain plug 214 for the tub, with, for example, an easy-to-grip knob 270, flexible retention legs 272 and a thread 274 for sealing the drain hole in the tub.

Figure 19:
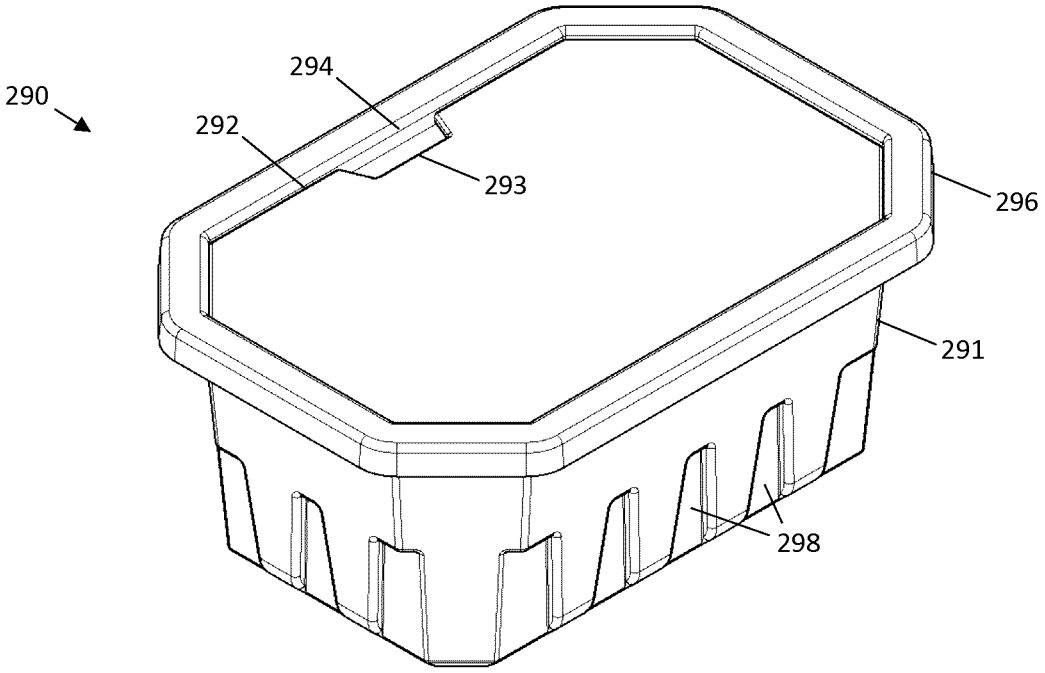
FIG. 19 is an isometric view of a box with a foldable mat, according to an embodiment of the present invention.
Figure 20:
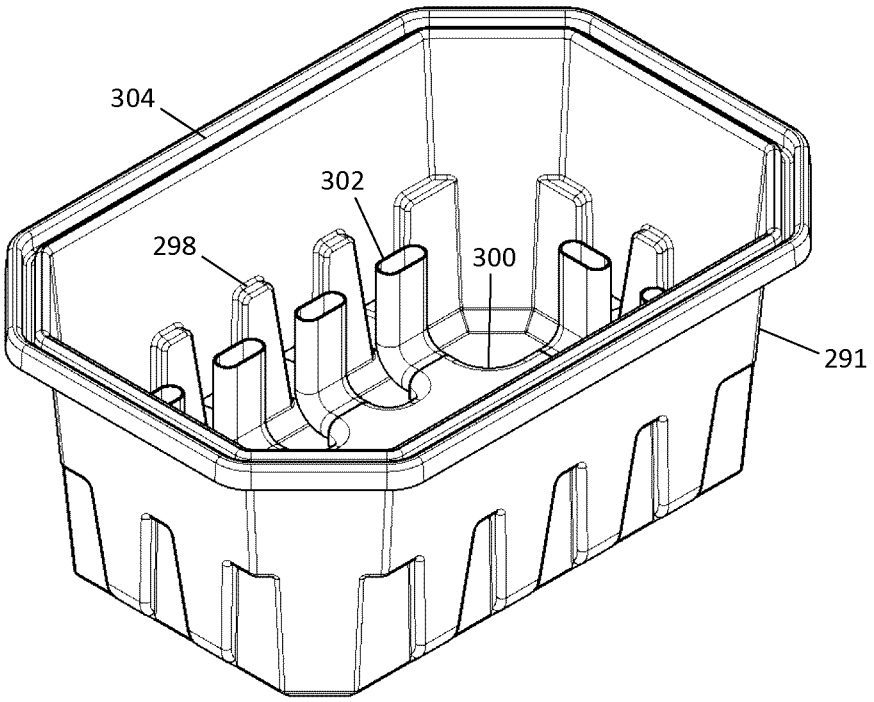
FIG. 20 is an isometric view of the tub of FIG. 19.
Figure 21:
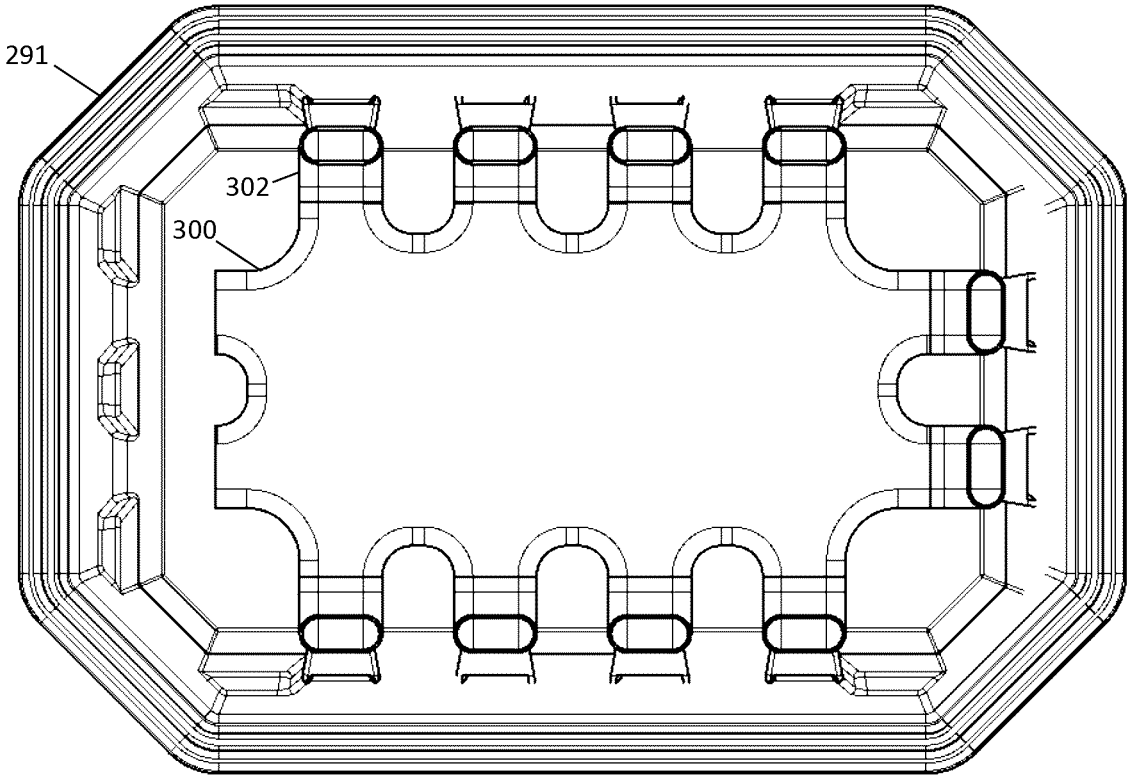
FIG. 21 is a plan view of the tub of FIG. 19.
Figure 22:
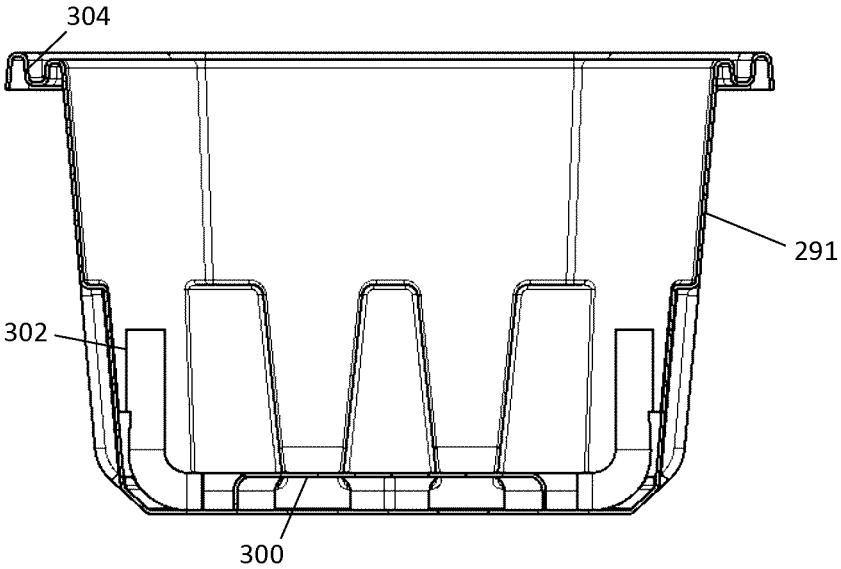
FIG. 22 is a cross-sectional view of the tub of FIG. 19.

FIG. 19 is another sport kit box 290, with tub 291 a foldable mat 292 having aligned cut-outs 293. The mat 292 rests or is wedged in a recess 294 in the lid 296. In use, the mat may be removed from the lid 296 by grasping it in the cut-out area, unfolded, and used for standing on, for example, while changing clothes, or changing into and out of sport kit. Indents or ribs 298 project inwards from the side and end walls of the tub 291. These ribs 298 have a tapered, dovetail cross-section and pairs of them form gaps with a dovetail cross-section on the inside of the tub. Accessory support ducts may be slotted into these gaps. FIG. 20 shows the inside of tub 291, in which a false bottom 300 is located. Ducts 302 for accessory supports are shown connected to the false bottom. Accessory supports may be mounted on the top ends of the ducts 302, between pairs of ribs 298. A channel 304 is present in the rim of the tub opening. FIG. 21 is a top view of the tub 291, showing the false bottom 300 and ducts 302. FIG. 22 is a cross-sectional view of the tub 291 taken across its width, also showing the false bottom 300 and ducts 302. The profile of the perimeter channel 304 is also visible.

Figure 23:
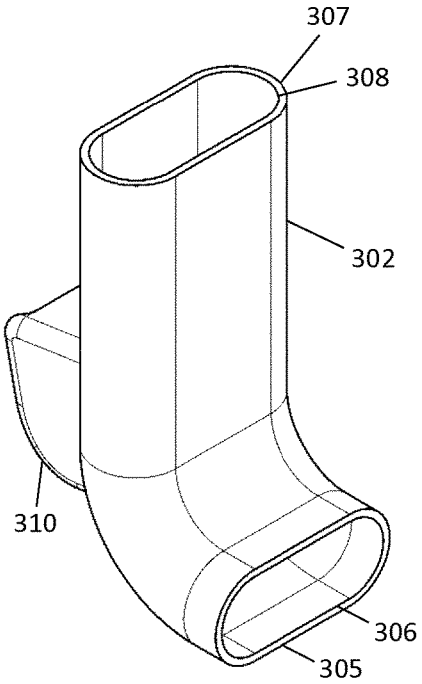
FIG. 23 is an isometric view of an accessory support duct, according to an embodiment of the present invention.
Figure 24:
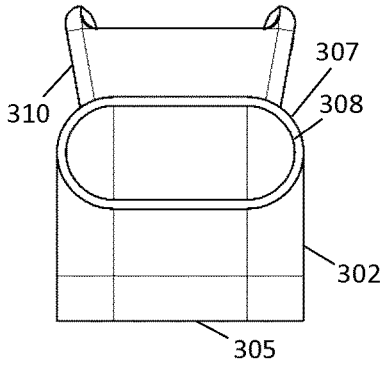
FIG. 24 is a top view of the accessory support duct of FIG. 23.
Figure 25:
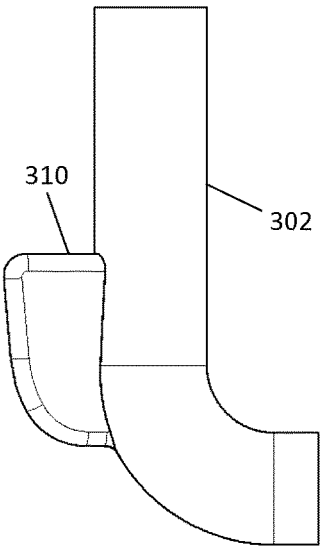
FIG. 25 is a side view of the accessory support duct of FIG. 23.

FIGS. 23-25 show an accessory support duct 302. The bottom end 305 of the accessory support duct 302 defines an aperture 306 at the opening of the duct. The top end 307 of the accessory support duct 302 defines aperture 308 at the other end of the duct. Air flows through the duct from the bottom end 305 to the top end 307. A projection 310 at the back of the accessory support duct 302 serves to locate the accessory support duct in position on the inside of the tub, between ribs 298. From the top, as seen in FIG. 24, the shape of the projection 310 is a dovetail, which engages with similarly-shaped dovetailed gaps between the projections on the inside of the tub.

Figure 26:
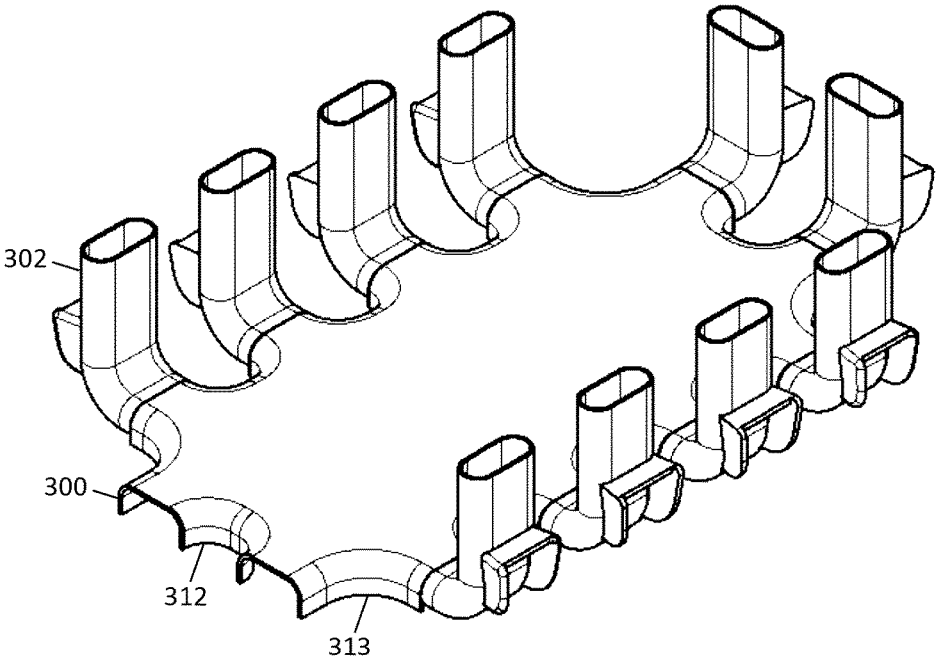
FIG. 26 is an isometric view of a false bottom with attached accessory support ducts, according to an embodiment of the present invention.

FIG. 26 shows the false bottom 300 with ten attached accessory support ducts 302, although in this embodiment of the false bottom there is enough space to add two more. However, one or both of these two attachment points are connected by ducting to the incoming airflow. Any attachment points that do not have a connected accessory support duct may either be closed with a plug or left open to allow air to directly enter the inner volume of the tub for directly drying the clothing inside it. In other embodiments, the false bottom has attachment points for a different number of accessory support ducts. Accessory support ducts and accessory holders may be disconnected and stored under or on the false bottom, which allows for improved nesting of the tubs for shipping, compared to if the accessory support ducts were shipped in the assembled configuration shown here. The lower edge 312 of the false bottom 300 is shaped so that it rests flush with the base of the tub, so that airflow is directed through the accessory support ducts 302. Corners 313 of the false bottom 300 are shaped and dimensioned to accommodate a beverage can or bottle, so that it can be placed on the bottom floor of the tub while the false bottom is in place. Also, the shape of the corners 313 matches the shape of the beverage container so that it is held firmly in an upright position. Corners 313 may be of different size to accommodate different sizes of beverage container. The false bottom, in cooperation with one or more walls of the tub, defines the holder for the beverage container.

Figure 27:
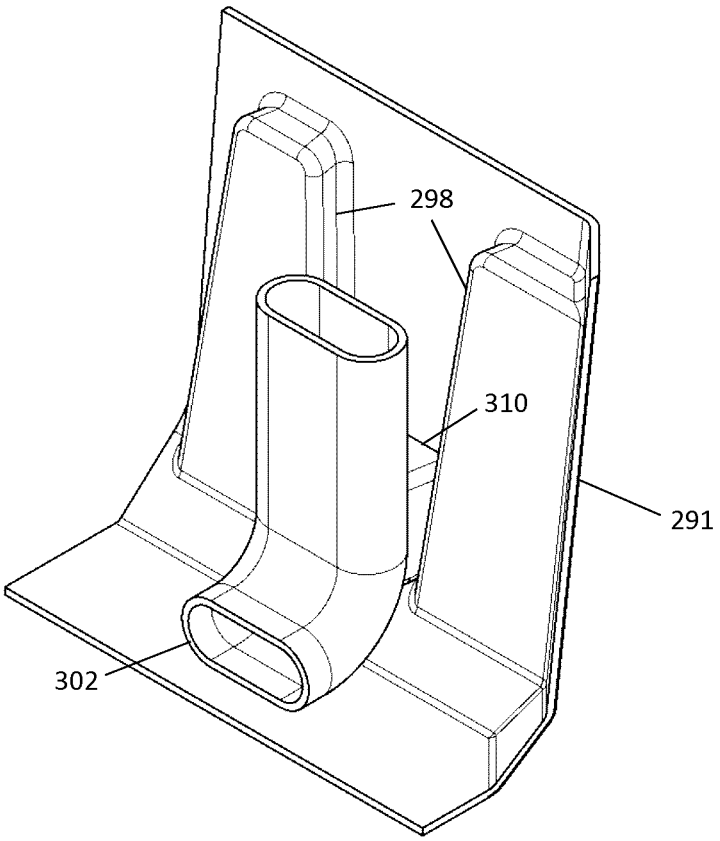
FIG. 27 is an isometric view of a portion of a tub wall with an interlocked accessory support duct, according to an embodiment of the present invention.
Figure 28:
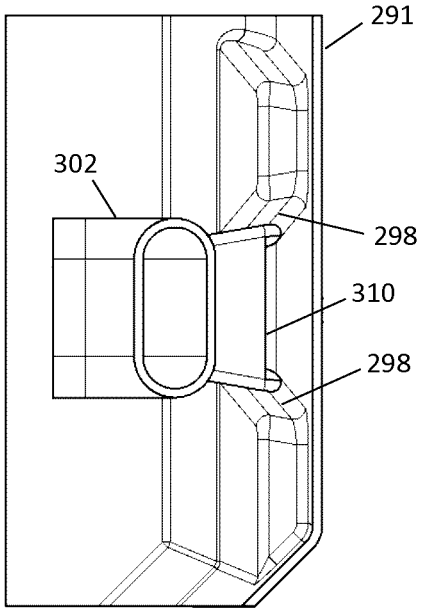
FIG. 28 is a top view of the tub portion of FIG. 27.

FIGS. 27-28 show a portion of a side or end of a tub 291, with an interlocked accessory support duct 302. The dovetail projection 310 is shown in the corresponding dovetail space between the projections or ribs 298 on the inside of the tub 291. More generally, there are at least two projections on an inner wall of the tub with which the support duct 302 engages, thereby preventing the support duct from moving horizontally away from the inner wall.

C. Variations

Features from one embodiment may be combined with features of another embodiment, and one or features may be omitted in some embodiments. Vents may be included in either or both of the lid and the tub to allow air that is forced in by the fan to escape. One or more of the components of the sport kit box may in some embodiments be nestable for efficient packaging and economical shipping. In some embodiments, the beverage container holders are dimensioned for holding coffee mugs, thermally insulated flasks etc. that fit snugly into them or onto them, reducing the chance of spillage inside the box when in transport. In some embodiments, the outside of the box has one or more attachments that fit into the indents that form the internal ribs for locating the accessory support ducts, or that fit into other indents. In these embodiments, the accessories may mount via a "V"-shaped groove, a dovetail groove, a tapered hole, rails or other mounting projection or indentation.

In some embodiments, the lid may be equipped with one or more solar panels for generating electricity to charge a rechargeable battery installed in the box, either in the lid or the tub. Electrical connections between the solar panels in the lid and the electrical components attached to the tub may be made using a suitable length of cable, or they may be formed by connectors such as a socket and plug. The battery, when charged, may then drive the fan and/or a heater instead of using the external power source provided by a vehicle or a home electricity supply. The lid with the photovoltaic cells may be positioned to optimize the amount of sunlight falling on it. In some embodiments, photovoltaic cells may be included on one or more of the outer walls of the tub. The battery may also be charged via a vehicle's power outlet or from an outlet in the home.

Figure 29:
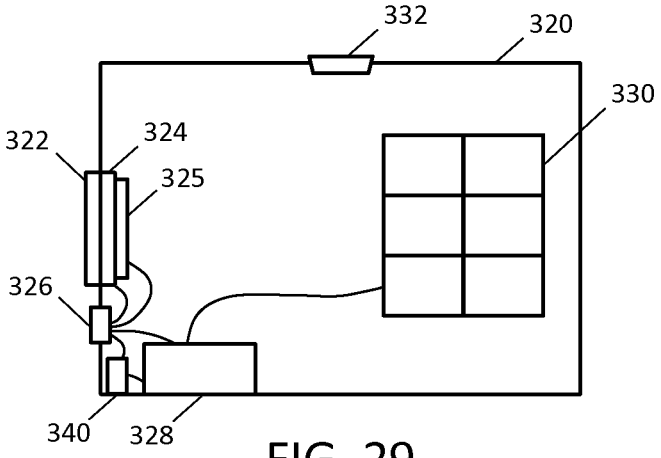
FIG. 29 is a schematic diagram of a sport kit box with electrical components, according to an embodiment of the present invention.

Referring to FIG. 29, a sport kit box 320 is shown, with filter 322 and internal fan 324 mounted to draw air in through the filter or force air out through it. Also shown is an internal heater 325 mounted on the fan 324. The fan 324 and heater 325 are electrically connected to a socket 326, via which electricity from a house, a vehicle or an external battery may be provided. Inside the box 320 is a rechargeable battery 328, electrically connected to the socket 326 and a solar panel 330 mounted on the outside of the box, either on the lid or on a wall of the box. Also shown is a vent 332 in the side of the box, which is openable and closable depending on the configuration of the box and the operating mode of the fan. A control unit 340 may be electrically connected to all the electrical components in the box, and it may have a wireless or physical user interface.

Throughout the description, specific details have been set forth in order to provide a more thorough understanding of the invention. However, the invention may be used without these particulars. In other instances, well-known elements have not been shown or described in detail, and repetitions of steps and features have been omitted to avoid unnecessarily obscuring the invention. Accordingly, the specifications and drawings are to be regarded in an illustrative, rather than a restrictive, sense.

It will be clear to one having skill in the art that further variations to the specific details disclosed herein can be made, resulting in other embodiments that are within the scope of the invention disclosed. All parameters, dimensions, materials, positions, quantities and configurations described herein are examples only and may be changed depending on the specific embodiment.

The invention claimed is:

1. A sport kit box comprising:
a tub;
a lid that closes the tub; and
a slot on each of two opposing sides of the tub, each slot shaped to engage with an edge of the lid so that the slots support the lid in a vertical plane when the tub is resting on a horizontal surface.

2. The sport kit box of claim 1, further comprising a rack with at least one strut that is slidable in and out of an end of the lid, the rack being adjustable between a retracted position in which the strut is mostly inside the lid and an extended position in which the strut is mostly outside the lid.

3. The sport kit box of claim 1, further comprising:
an inlet for air;
an accessory support defining a duct that leads to perforations in the accessory support;
a false bottom defining ducting that connects the inlet to the duct in the accessory support or to a further duct on which the accessory support is mounted.

4. The sport kit box of claim 3, wherein the ducting connects the inlet to the duct in the accessory support directly or via another duct.

5. The sport kit box of claim 3, further comprising a socket on a floor of the tub that engages with the accessory support.

6. The sport kit box of claim 5, wherein when the box is closed with the lid, the lid prevents the accessory support from rising out of the socket.

7. The sport kit box of claim 3, wherein the accessory support is a bootie holder, a glove holder, a goggle box or a platform.

8. The sport kit box of claim 3, wherein the false bottom is perforated.

9. The sport kit box of claim 3, wherein the accessory support and the false bottom are removable.

10. The sport kit box of claim 3, wherein the accessory support is a perforated tube.

11. The sport kit box of claim 10, wherein the perforated tube:
is connectable at each end to a different socket on a floor of the tub to form an arch that extends beyond a height of the tub; and
coils so that it fits inside the box when the box is closed with the lid.

12. The sport kit box of claim 1, further comprising a removable lock box mounted on an outer surface of the tub.

13. The sport kit box of claim 1, further comprising a removable filter mounted on an outer surface of the tub.

14. The sport kit box of claim 1, further comprising a drain plug that fits a drain hole in the tub.

15. The sport kit box of claim 1 wherein:
a top of the lid has a non-slip surface; or
at least one raised ridge on the top of the lid defines multiple sections of the lid.

16. The sport kit box of claim 1, made of rigid plastic.

17. The sport kit box of claim 1, further comprising a holder for a beverage container inside the tub.

18. The sport kit box of claim 17, further comprising a false bottom, which in cooperation with one or more walls of the tub, defines the holder.

19. The sport kit box of claim 17, further comprising projections extending from an inner surface of a wall of the tub, the projections defining the holder.

20. The sport kit box of claim 4, further comprising:
the other duct; and
at least two projections on an inner wall of the tub;
wherein the other duct engages with the two projections thereby preventing the other duct from moving horizontally away from the inner wall.

21. The sport kit box of claim 1, further comprising a fan, a heater, a rechargeable battery, an electrical socket, a solar panel, a control unit or any combination selected therefrom.

22. The sport kit box of claim 1, further comprising a foldable mat that fits into a recess in a top surface of the lid.

23. The sport kit box of claim 1, further comprising an accessory that is removably attachable to an outer wall of the tub.

* * * * *